US005725908A

United States Patent [19]

Ogasawara et al.

[11] Patent Number: 5,725,908

[45] Date of Patent: Mar. 10, 1998

[54] COATING METHOD

[75] Inventors: Toshifumi Ogasawara; Toshiyuki Sakoda, both of Hiroshima-ken, Japan

[73] Assignee: Mazda Motor Corporation, Hiroshima-ken, Japan

[21] Appl. No.: 721,970

[22] Filed: Sep. 27, 1996

Related U.S. Application Data

[63] Continuation of Ser. No. 329,942, Oct. 26, 1994, abandoned.

[30] Foreign Application Priority Data

Oct. 28, 1993 [JP] Japan ..... 5-270106

[51] Int. Cl.[6] ..... B05D 1/36; B05D 1/38; B05D 5/06

[52] U.S. Cl. ..... 427/407.1; 427/355; 427/379; 427/409

[58] Field of Search ..... 427/140, 409, 427/410, 142, 203, 407.1, 379, 380, 355, 316

[56] References Cited

U.S. PATENT DOCUMENTS

| | | | |
|---|---|---|---|
| 3,639,147 | 2/1972 | Benefiel et al. | 427/409 |
| 4,265,936 | 5/1981 | Prohaska, Jr. | 427/142 |
| 4,546,007 | 10/1985 | Abe et al. | 427/8 |
| 4,615,940 | 10/1986 | Panush et al. | 427/407.1 |
| 4,692,481 | 9/1987 | Kelly | 523/219 |
| 4,740,566 | 4/1988 | Tremper, III | 525/438 |
| 4,968,530 | 11/1990 | Yamane et al. | 427/142 |
| 4,981,759 | 1/1991 | Nakatani et al. | 427/410 |
| 5,068,288 | 11/1991 | Talian et al. | 427/142 |
| 5,102,692 | 4/1992 | Tanigami et al. | 427/142 |
| 5,319,437 | 6/1994 | Von Aken | 356/326 |

FOREIGN PATENT DOCUMENTS 62-160165 7/1987 Japan .

*Primary Examiner*—Diana Dudash

*Attorney, Agent, or Firm*—Sixbey, Friedman, Leedom & Ferguson, PC; Gerald J. Ferguson, Jr.; Donald R. Studebaker

[57] ABSTRACT

A color coating composition is applied on a primer coating layer on a work to form an intercoating layer, and the intercoating layer is dried. A color coating composition of a predetermined color is applied on the intercoating layer to form thereon a color base layer, and a coating composition containing therein a lustering material is applied on the color base layer by wet-on-wet system to form thereon a lustering material base layer. A clear coating composition is applied on the lustering material base layer to form a clear layer. Then the coating films thus obtained are dried. The color of the color coating composition for forming the intercoating layer is equal to or resembles that of the color coating composition for forming the color base layer.

7 Claims, 4 Drawing Sheets

COATING METHOD

This application is a Continuation of Ser. No. 08/329,942, filed Oct. 26, 1994, now abandoned.

BACKGROUND OF THE INVENTION

1. Field of the Invention

This invention relates to a method of coating a work with a coating composition containing therein lustering material such as aluminum or mica.

2. Description of the Prior Art

For example, the outer surface of a vehicle body is coated with a primer coating for the purpose of rust prevention, an intercoating for the purpose of surface process to improve finish and a topcoating for the purpose of improvement in appearance and durability. Recently metallic coating, pearl coating and the like formed of coating compositions containing therein lustering material such as aluminum or mica are attracting attention as the topcoating. In Japanese Unexamined Patent Publication No. 62(1987)-160165, there is disclosed a two-coat one-bake system for the topcoating in which, as shown in FIG. 5, an intercoating layer b which is black, gray, white or the like in color is applied on a primer coating layer a and is dried, then a coating composition containing titanized mica pigment (6 to 8 wt %) is applied on the intercoating layer b to form a lustering material-color base layer c (15 to 20 μm thick), and then a clear coating composition is applied on the lustering material-color base layer c by wet-on-wet coating to form a clear layer d (30 μm thick). With such a two-coat one-bake system for the topcoating, the intercoating layer b can be seen through the topcoating layer by lowering the hiding power of the lustering material-color base layer c, whereby the coating appears a mixture of the colors of the clear layer d, the lustering material-color base layer c and the intercoating layer b.

When adhesion of dust and/or cissing are found in the intercoating layer b, abrasion is effected to repair the defect. However when the defect is large, marks of abrasion are seen through the topcoating, which results in defective coating.

In order to overcome such a problem, conventionally a color base coating composition is applied on the intercoating layer b to form a color base layer e 30 to 35 μm thick as shown in FIG. 6. That is, by hiding the intercoating layer b in the color base layer e, repair of the intercoating layer b is permitted. After the color base layer e is dried, a lustering material base layer f and a clear layer d are formed on the color base layer e in this order by wet-on-wet coating and then dried. This topcoating is of a three-coat two-bake system.

However the conventional coating method is disadvantageous in that an additional drying step is required for formation of the color base layer and productivity deteriorates, which adds to the cost of coating.

SUMMARY OF THE INVENTION

In view of the foregoing observations and description, the primary object of the present invention is to provide a coating method which permits repair of the base layer without an additional drying step.

In accordance with the method of the present invention, an intercoating layer is formed by applying a coating composition equal to or resembling a color base layer in color on a primer coating layer. When the intercoating layer resembles the color base layer in color, marks of repair on the intercoating layer less show and can be hidden in a relatively thin color base layer which can be formed without drying step.

That is, in accordance with the present invention, there is provided a method of coating comprising the steps of applying a color coating composition on a primer coating layer on a work to form an intercoating layer, drying the intercoating layer, applying a color coating composition of a predetermined color on the intercoating layer to form thereon a color base layer, applying a coating composition containing therein a lustering material on the color base layer by wet-on-wet system to form thereon a lustering material base layer, applying a clear coating composition on the lustering material base layer to form a clear layer, and then drying the coating films thus obtained, wherein the color of said color coating composition for forming the intercoating layer is equal to or similar to that of the color coating composition for forming the color base layer.

In this method, after the intercoating layer is dried, the color coating composition is applied on the intercoating layer and the color base layer is formed. Since the intercoating layer resembles the color base layer in color, marks of repair on the intercoating layer becomes less noticeable and can be hidden in a relatively thin color base layer. Accordingly the color base layer need not be dried before application of the coating composition containing the lustering material. The coating films are dried after the formation of the clear layer. That is, the coating method of the present invention is of a three-coat one-bake system.

Preferably the coating compositions for the color base layer and the lustering material base layer comprise the same resin materials in order to prevent generation of strain between the color base layer and the lustering material base layer due to difference in the reaction rate.

Further it is preferred that the solvent in the coating composition for the color base layer be evaporated at a rate higher than that of the solvent in the coating composition for the lustering material base layer so that the coating compositions are prevented from becoming intimate with each other and generation of color shading due to immigration of the lustering material is prevented.

DESCRIPTION OF THE PREFERRED EMBODIMENTS

First Embodiment

Figure 1:
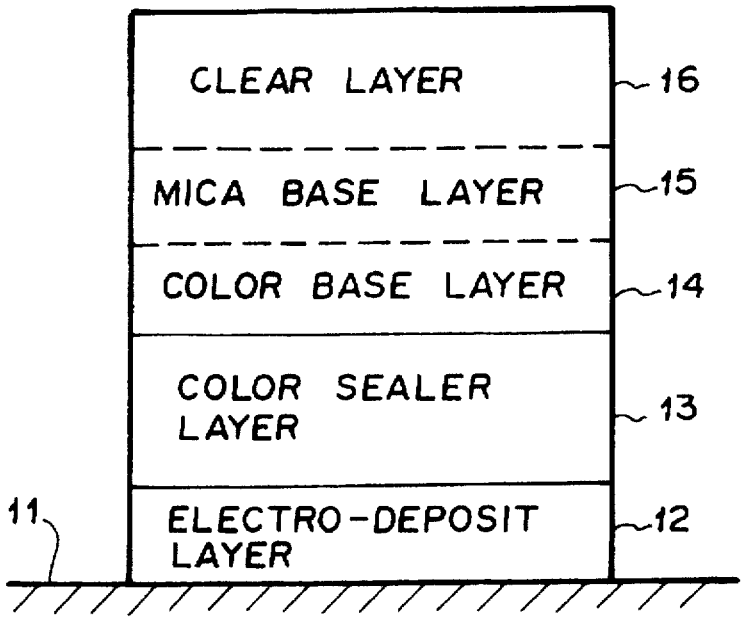
FIG. 1 is a schematic view showing the arrangement of layers in pearl white coating coated on the inner and outer plates of a vehicle body by a coating method in accordance with a first embodiment of the present invention.
Figure 2:
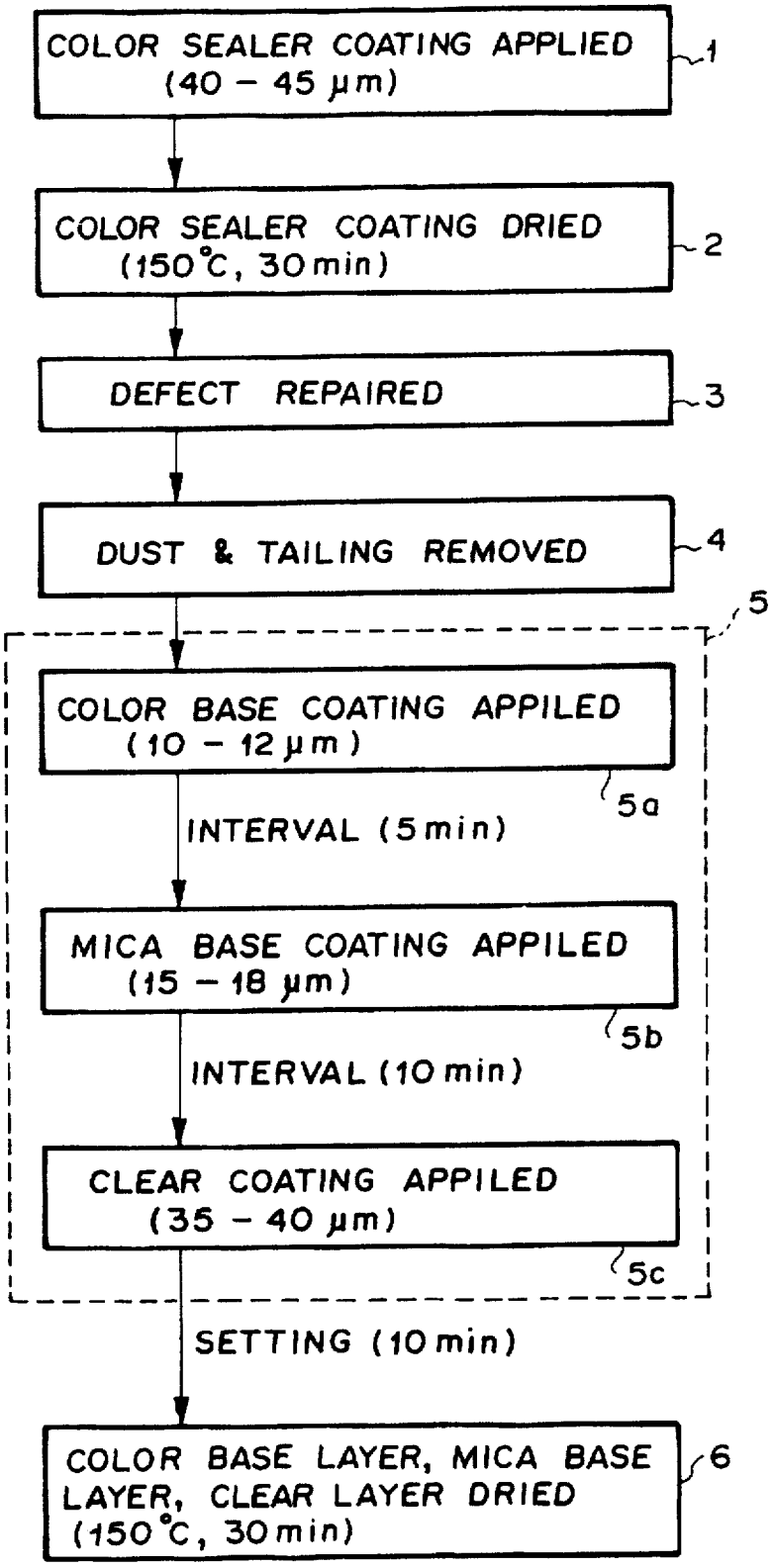
FIG. 2 is a flow sheet for illustrating the coating method in accordance with the first embodiment.

In the first embodiment, white mica was used as the lustering material, and a vehicle body was coated with pearl white coating. As shown in FIG. 1, a color sealer layer (as the intercoating layer) 13, a color base layer 14, a mica base layer 15 and a clear layer 16 were formed on a work (including inner and outer plates of the vehicle body) 11 which had been applied with an electro-deposit layer 12 (as the primer coating layer). This coating comprised an intercoating step 1, a drying step 2, an abrasion repair step 3, a preparation step 4, a topcoating step 5 and a drying step 6 as shown in FIG. 2.

In the intercoating step 2, a color sealer coating composition containing therein white as the main pigment was applied to the electro-deposit layer 12 and a color sealer layer 13 (40 to 45 μm thick) was formed. The composition of the color sealer coating composition was as shown in table 1. The viscosity of the coating composition was 22 sec/#4FC·20° C. and the black-and-white hiding film thickness was 40 μm.

TABLE 1

(color sealer coating composition)

| component | wt % |
|---|---|
| epoxy-modified polyester melamine resin | 32 |
| pigment | 30 |
| white | 30 |
| black | small amount |
| yellow | small amount |
| red | small amount |
| solvent | 38 |
| total | 100 |

In the drying step 2, the color sealer layer 13 was baked and dried for 30 minutes at 150° C. Then in the abrasion repair step 3, defect in the color sealer layer 13 was repaired, and then in the preparation step 4, dust and abrasion tailing generated in the abrasion repair step 3 are removed.

The topcoating step 5 included first to third coating steps 5*a* to 5*c*. In the first coating step 5*a*, a color base coating composition containing therein white as the main pigment was applied on the color sealer layer 13 and a color base layer 14 (10 to 12 μm thick) was formed. The composition of the color base coating composition was as shown in table 2. The viscosity of the coating composition was 13.5 sec/#3FC·20° C. and the black-and-white hiding film thickness was 10 to 12 μm. Further the components in the solvent in the color base coating composition was adjusted so that the solvent evaporated at a rate higher than the solvent to be used in the mica base coating composition to be used in the second coating step. More particularly, a mixture of toluene and xylene, the former evaporates at a higher rate than the latter, were used for both the color base coating composition and the mica base coating composition, and the proportion of the toluene to the xylene was made larger in the color base coating composition. Five minutes after the first coating step 5*a*, the second coating step 5*b* was performed.

TABLE 2

(color base coating composition)

| component | wt % |
|---|---|
| acrylic melamine resin | 13.5 |
| pigment | 4.5 |
| white | 4.5 |
| black | small amount |
| yellow | small amount |
| red | small amount |
| solvent | 82 |
| total | 100 |

In the second coating step 5*b*, a mica base coating composition containing was applied on the color base layer 14 by wet-on-wet and a mica base layer 15 (15 to 18 μm thick) was formed. The composition of the mica base coating composition was as shown in table 3. The viscosity of the coating composition was 13.5 sec/#3FC·20° C. and the black-and-white hiding film thickness was 350 μm. Further as the resin component in the mica base coating composition, acrylic melamine resin was used as in the color base coating composition. Ten minutes after the second coating step 5*b*, the third coating step 5*c* was performed.

TABLE 3

(mica base coating composition)

| component | wt % |
|---|---|
| acrylic melamine resin | 15.1 |
| white mica | 0.9 |
| solvent | 84 |
| total | 100 |

In the third coating step 5*c*, a clear coating composition was applied on the mica base layer 15 by wet-on-wet and a clear layer 16 (35 to 40 μm thick) was formed. The composition of the clear coating composition was as shown in table 4. The viscosity of the coating composition was 21 sec/#4FC·20° C.

TABLE 4

(clear coating composition)

| component | wt % |
|---|---|
| acrylic melamine resin | 42 |
| solvent | 58 |
| total | 100 |

After the third coating step 5*c*, the coating compositions were set for 10 minutes and the drying step 6 was performed. In the drying step 6, the coating composition were baked and dried for 30 minutes at 150° C.

In the first embodiment, since the color sealer layer 13 formed in the intercoating step 1 is equal to or similar to the color base layer 14 formed in the topcoating step 5 in color, marks of repair on the color sealer layer 13 less show and can be hidden in a relatively thin color base layer 14 (10 to 12 μm in this particular embodiment). Accordingly formation of the color base layer 14 does not require a drying step.

Further since the coating compositions for the color base layer 14 and the mica base layer 15 comprise the same resin materials, generation of strain between the color base layer 14 and the mica base layer 15 due to difference in the reaction rate can be prevented when the latter layer is formed on the former layer by wet-on-wet. Accordingly the color base layer 14 need not be dried. Further, since the solvent in the coating composition for the color base layer 14 evaporates at a rate higher than that of the solvent in the coating composition for the mica base layer 15, the coating compositions are prevented from becoming intimate with each other and generation of color shading due to immigration of the mica material is prevented.

Though, in the first embodiment, a mica base coating composition without pigment was used for forming the mica base layer 15, a mica base coating composition containing therein the same pigment (white in this particular embodiment) as that in the color base coating composition as shown in table 5 may be used.

TABLE 5

(mica base coating composition)

| component | wt % |
|---|---|
| acrylic melamine resin | 14.7 |
| white mica | 2.4 |
| pigment | 0.3 |
| white | 0.3 |
| yellow | small amount |
| solvent | 83 |
| total | 100 |

Second Embodiment

Figure 3:
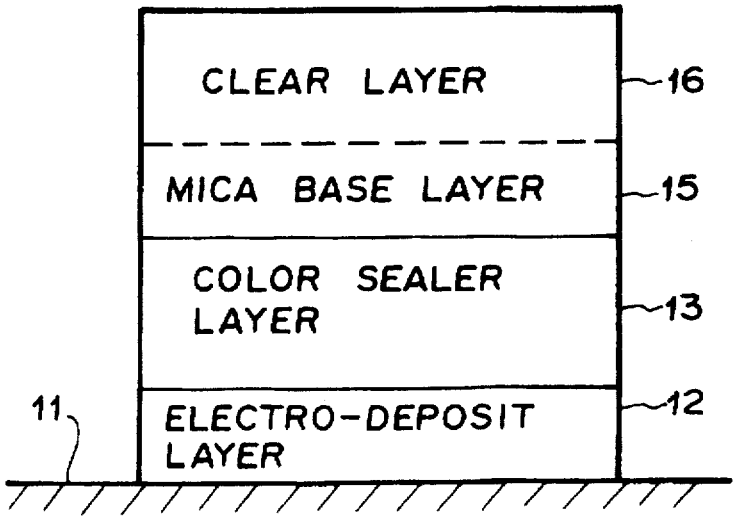
FIG. 3 is a schematic view showing the arrangement of layers in pearl white coating coated on the inner plate of a vehicle body by a coating method in accordance with a second embodiment of the present invention.
Figure 4:
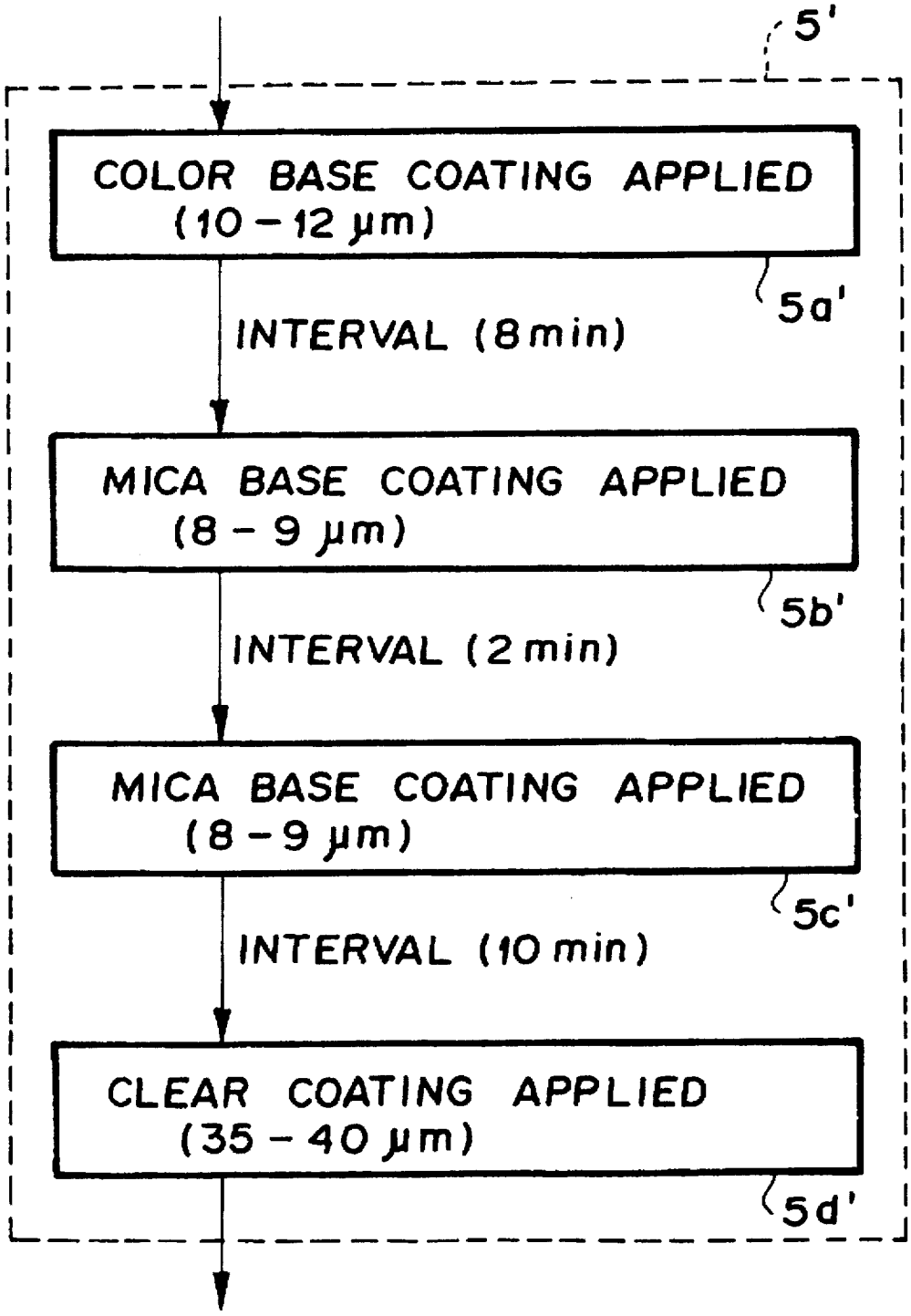
FIG. 4 is a flow sheet for illustrating the coating method in accordance with the second embodiment.
Figure 5:
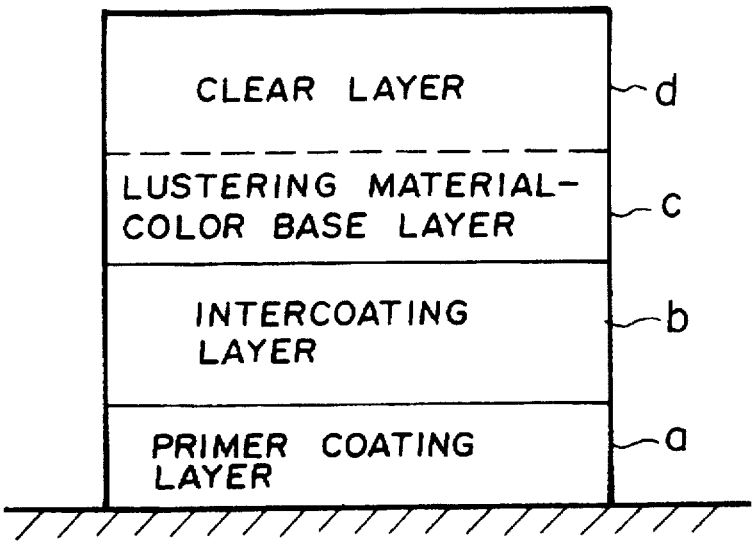
FIG. 5 PRIOR ART
FIG. 5 is a view similar to FIG. 1 but showing a conventional method in which the topcoating is formed by a two-coat one-bake system.
Figure 6:
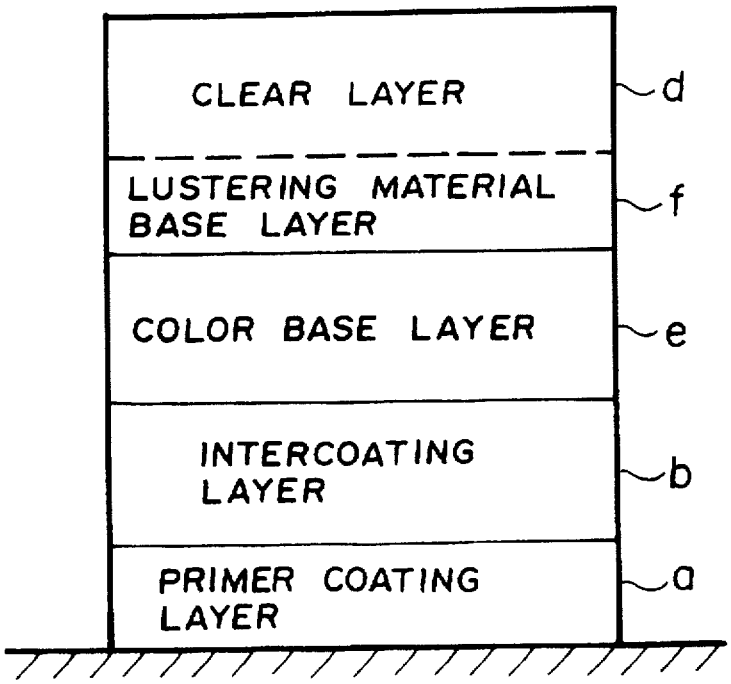
FIG. 6 PRIOR ART
FIG. 6 is a view similar to FIG. 1 but showing a conventional method in which the topcoating is formed by a three-coat two-bake system.

In the second embodiment, mica base coating composition was coated in two steps and the color base coating composition was coated only on the outer plate of the vehicle body and was not coated on the inner plate. FIG. 3 shows the arrangement of layers on the inner plate. FIG. 4 shows the topcoating step 5' in the second embodiment and the other steps are the same as those in the first embodiment. As shown in FIG. 3, in the pearl coating of the inner plate, an electro-deposit layer 12, a color sealer layer 13, a a mica base layer 15 and a clear layer 16 are formed on an electro-deposit layer 12.

The topcoating step 5' in the second embodiment comprised first to fourth coating steps **5*a*' to 5*d*'. In the first coating step 5*a*', a color base coating composition was applied only on the electro-deposit layer 12 of the outer plate and a color base layer 14 was formed on the electro-deposit layer 12. About eight minutes after the first coating step 5*a*', the second coating step 5*b*' was performed, and about two minutes after the second coating step 5*b*', the third coating step 5*c*' was performed. In each of the second and third coating steps 5*b*' and 5*c*', the mica base coating composition was applied to both the inner and outer plates in thickness of 8 to 9 μm, thereby forming a mica base layer 15 16 to 18 μm thick. About ten minutes after the third coating step 5*c*', the fourth coating step 5*d*' was performed and a clear coating composition was applied on the mica base layer 15**.

Also in the second embodiment, the same effect as in the first embodiment can be obtained. Further, in the second embodiment, since the mica base coating composition is applied in two steps, the mica base coating composition can be well applied even if the vehicle body is conveyed at a high speed in the coating line.

What is claimed is:

1. A method of coating comprising the steps of applying a color coating composition on a primer coating layer on a work to form an intercoating layer, drying the intercoating layer, applying a color coating composition of a color which is equal to a color of the intercoating layer to form thereon a color base layer, said color base layer being of a thickness less than said intercoating layer and applied at less than full hiding over the intercoating layer;

applying a coating composition containing therein a lustering material on the color base layer by wet-on-wet system to form thereon a lustering material base layer, applying a clear coating composition on the lustering material base layer by wet-on-wet system to form a clear layer, and then drying the coating films thus obtained;

wherein the coating has an appearance of being a mixture of colors of the layers and said coating composition for said color base layer and said lustering material base layer comprise the same resin materials.

2. A method of coating as defined in claim 1 in which solvent in the coating composition for the color base layer is evaporated at a rate higher than that of solvent in the coating composition for the lustering material base layer.

3. A method of coating comprising the steps of applying a color coating composition on a primer coating layer on a work to form an intercoating layer, drying the intercoating layer, repairing the intercoating layer by abrasion, applying a color coating composition of a color which is substantially equal to a color of the intercoating layer to form thereon a color base layer, said color base layer being of a thickness less than said intercoating layer and applied at less than full hiding over the intercoating layer;

applying a coating composition containing therein a lustering material on the color base layer by wet-on-wet system to form thereon a lustering material base layer, applying a clear coating composition on the lustering material base layer by wet-on-wet system to form a clear layer, and then drying the coating films thus obtained.

4. A method of coating comprising the steps of applying a color coating composition, including a resin, pigment and solvent, on a primer coating layer on a work to form an intercoating layer, drying the intercoating layer, applying a color coating composition, including a resin and pigment, said color coating composition being of a color which is substantially equal to a color of the pigment of the intercoating layer and solvent to form thereon a color base layer, said color base layer being of a thickness less than said intercoating layer and applied at less than full hiding over the intercoating layer;

applying a coating composition, including resin, mica and a solvent, on the color base layer by wet-on-wet system to form thereon a lustering material base layer, applying a clear coating composition on the lustering material base layer by wet-on-wet system to form a clear layer, and then drying the coating films thus obtained;

wherein the coating has an appearance of being a mixture of colors of the layers and said coating composition for said color base layer and said lustering material base layer comprise the same resin materials.

5. A method of coating as defined in claim 4 further comprising the step of:

repairing the intercoating layer by abrasion before forming the color base layer.

6. A method of coating comprising the steps of applying a color coating composition on a primer coating layer on a work to form an intercoating layer, drying the intercoating layer, repairing the intercoating layer by abrasion, applying a color coating composition of a color which is equal to a color of the intercoating layer to form thereon a color base layer, said color base layer being of a thickness less than said intercoating layer and applied at less than full hiding over the intercoating layer;

applying a coating composition containing therein a lustering material on the color base layer by wet-on-wet system to form thereon a lustering material base layer, applying a clear coating composition on the lustering material base layer by wet-on-wet system to form a clear layer, and then drying the coating films thus obtained;

wherein the coating has an appearance of being a mixture of colors of the layers and said coating composition for said color base layer and said lustering material base layer comprise the same resin materials.

7. A method of coating comprising the steps of applying a color coating composition on a primer coating layer on a work to form an intercoating layer, drying the intercoating layer, applying a color coating composition of a color which is equal to a color of the intercoating layer to form thereon a color base layer, said color base layer being of a thickness less than said intercoating layer and applied at less than full hiding over the intercoating layer;

applying a coating composition containing therein a lustering material on the color base layer by wet-on-wet system to form thereon a lustering material base layer, applying a clear coating composition on the lustering material base layer by wet-on-wet system to form a clear layer, and then drying the coating films thus obtained;

wherein the coating has an appearance of being a mixture of colors of the layers.

* * * * *